US005163110A

United States Patent [19]

Arthur et al.

[11] Patent Number: 5,163,110

[45] Date of Patent: Nov. 10, 1992

[54] PITCH CONTROL IN ARTIFICIAL SPEECH

[75] Inventors: William J. Arthur, Capistrano Beach; Richard P. Sprague, El Toro, both of Calif.

[73] Assignee: First Byte, Torrance, Calif.

[21] Appl. No.: 566,963

[22] Filed: Aug. 13, 1990

[51] Int. Cl.[5] ..... G10L 9/00

[52] U.S. Cl. ..... 395/2

[58] Field of Search ..... 381/36–40, 381/49, 50, 51–53; 395/2

[56] References Cited

U.S. PATENT DOCUMENTS

| | | | |
|---|---|---|---|
| 3,892,919 | 7/1975 | Ichikawa | 381/51 |
| 4,163,120 | 7/1979 | Baumwolspiner | 381/51 |
| 4,624,012 | 11/1986 | Lini et al. | 381/52 |
| 4,692,941 | 9/1987 | Jacks et al. | 381/52 |
| 4,709,390 | 11/1987 | Atal et al. | 381/51 |
| 4,817,161 | 3/1989 | Kaneko | 381/51 |
| 4,833,718 | 5/1990 | Sprague | 381/52 |
| 4,896,359 | 1/1990 | Yamamoto et al. | 381/52 |

*Primary Examiner*—Allen R. MacDonald
*Assistant Examiner*—David D. Knepper
*Attorney, Agent, or Firm*—Weissenberger, Peterson, Uxa & Myers

[57] ABSTRACT

Substantial pitch variations in artificial speech produced by dialing out a sequence of stored digital waveforms are made possible without significant distortion by varying pitch both by truncation or extension of pitch period waveforms, and by varying the dialout rate. In another aspect of the invention, pitch changes are made more natural by distributing each pitch change evenly over a large number of pitch periods during voiced phonemes.

7 Claims, 4 Drawing Sheets

PITCH CONTROL IN ARTIFICIAL SPEECH

FIELD OF THE INVENTION

This invention relates to a method of varying the pitch of artificial speech as a function of prosody, and more particularly to a method involving a mixture of dialout rate variation and waveform alteration.

BACKGROUND OF THE INVENTION

One conventional method of varying the pitch of voiced sounds in artificial speech involves deleting samples in the low-energy portion of pitch period waveforms, or inserting extra samples within or at the end of the waveform, to respectively shorten or lengthen the pitch periods.

This method is limited in its applicability because, in order to minimize the distortion of the pitch period's spectral characteristics, the deletion (truncation) or insertion (extension) must be made at "quiet" points in the pitch period waveform, i.e. points at which very little or no fundamental-frequency and lower harmonic energy is present in the waveform, and energy is present at most in the form of a low ripple. In a male voice, there are usually enough such points to accommodate substantial pitch variations, but in a female voice much less leeway exists in this respect. This is so because the female voice has many more pitch periods, each of which is much smaller (typically 100 samples vs. 250); consequently, any change in a pitch period has a much more drastic effect. In any event, truncation or extension does change the spectral characteristics (i.e. the sum-total of the fundamental frequency and its harmonics that make up the pitch period waveform), and therefore introduces distortion if used to excess.

Another method of varying the pitch involves changing the dialout rate of the waveform samples. This method again shortens or lengthens the time duration of the pitch periods, but although it merely shifts all the component frequencies of the waveform equally, the shift results in an unnatural-sounding, "Mickey Mouse"-like speech quality.

A pitch change in excess of about 20% by the former method or 10% by the latter method results in an unacceptable deterioration of speech quality; yet natural pitch variations due to prosody in real speech can be on the order of 40% in each direction from a norm.

SUMMARY OF THE INVENTION

The method of this invention achieves sufficient pitch change without excessive distortion by combining dialout rate changes with pitch period waveform truncation/extension. The combination of these pitch control methods produces the necessary pitch variation of about 20% without exceeding the allowable 10% change in either method individually.

In another aspect of the invention, pitch changes are made more natural-sounding by distributing the pitch change over one or more phonemes. This is accomplished by determining and effecting, for each pitch period, the amount of pitch variation that would, if applied to each pitch period, reach the pitch value required midway through the next phoneme in which a pitch change occurs. It will be understood that this target value is set by pitch codes preceding voiced phoneme codes, and therefore stays constant over a substantial number of pitch periods. By changing pitch as gradually as possible by the method of this invention, a smoother, more natural speech sound is achieved.

DESCRIPTION OF THE PREFERRED EMBODIMENT

U.S. Pat. No. 4,692,941 discloses a method of changing the pitch of an artificial voiced speech sound by truncating the end of individual pitch period waveforms (i.e. the portion immediately preceding the onset of the glottal pulse) to raise the pitch, or adding zeros to them at the end to lower the pitch.

Figure 1A:
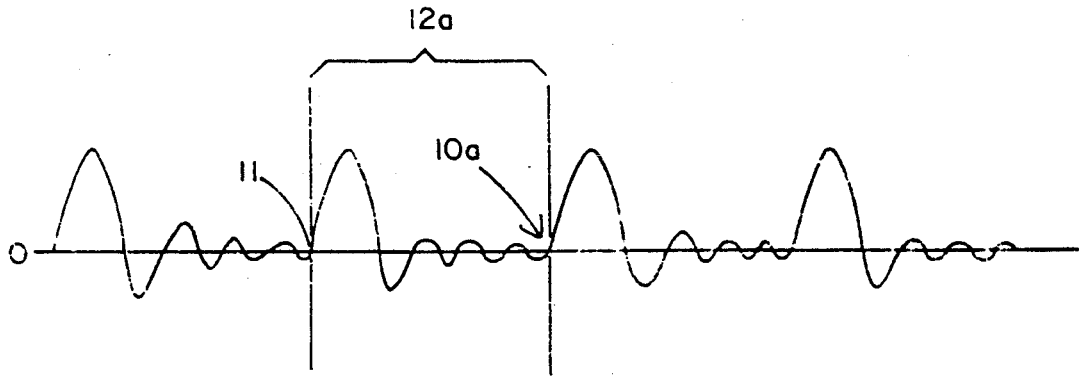
FIGS. 1*a* and 1*b* are time-amplitude diagrams illustrating the same speech sound as pronounced by a male and a female speaker, respectively.
Figure 1B:
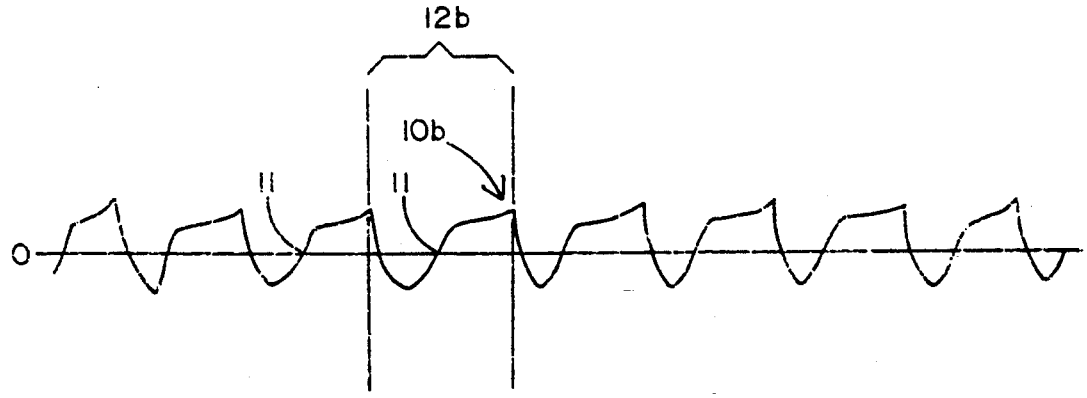

With respect to that method, it has now been found that for best results, the truncation or extension (which is not necessarily zero-padding) should be done not immediately preceding the onset of the glottal pulse, but rather at whatever point is the most quiescent point in the pitch period waveform, i.e. the point where high-frequency ripple is at a minimum. In the typical male voice (see FIG. 1*a* which illustrates a male speaker enunciating an "ee" sound as in "feet"), the most quiescent point 10*a* is indeed generally immediately before the onset 11 of the glottal pulse, and the pitch period 12*a* is comparatively long. In a typical female voice enunciating the same sound (FIG. 1*b*), however, the pitch period 12*b* is much shorter, and the most quiescent point 10*b* about half way between the two glottal pulse onsets 11. Therefore, the pitch period 12*b* of this sound may advantageously be measured from the quiescent point 10*b* so that truncation and extension may still be done at the end of the pitch period 12*b*.

Figure 2A:
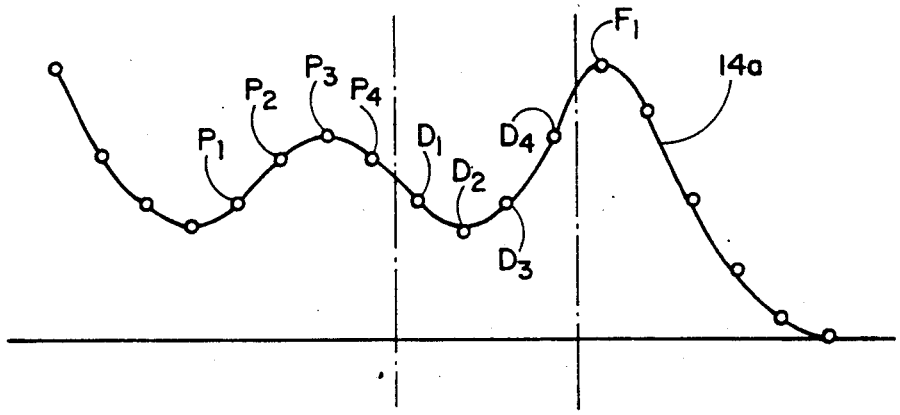
FIGS. 2*a*–2*c* are schematic block diagram illustrating a sequence of pitch codes and phoneme codes.
Figure 2B:
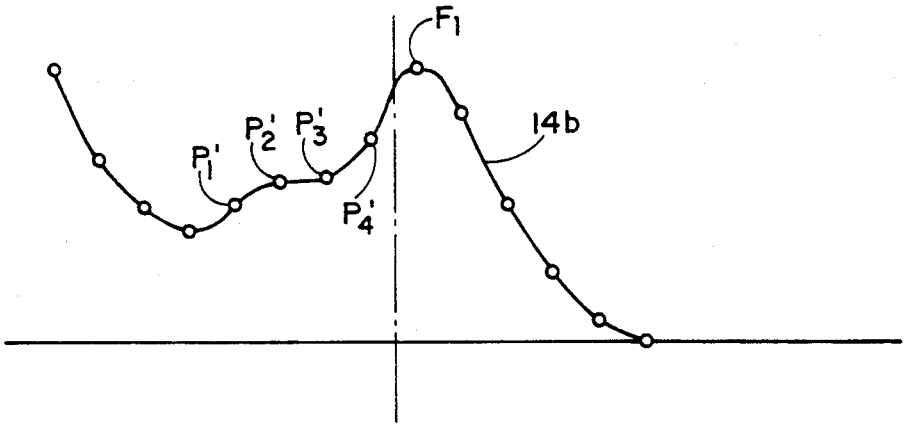
Figure 2C:
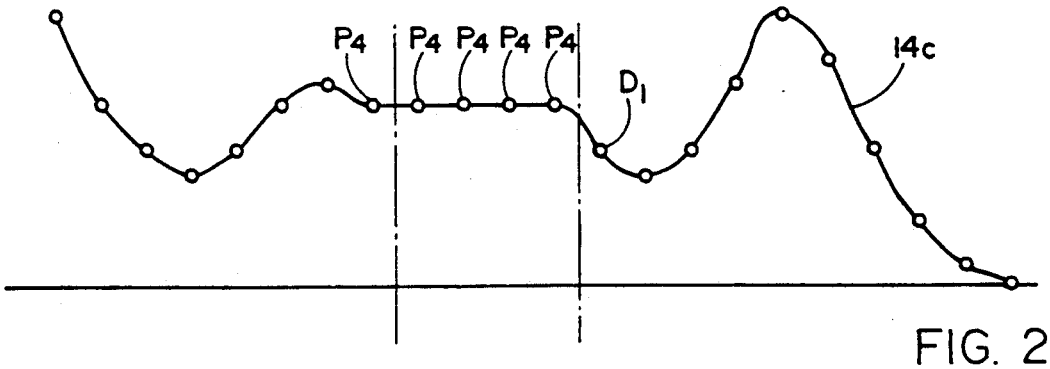

Wherever the waveform of pitch period 12*a* or 12*b* is truncated or extended, it is necessary to smooth the truncation by interpolating, in the case of truncation, the adjacent samples with the deleted samples. FIGS. 2 and 2*b* illustrates the deletion of four samples $D_1$ through $D_4$ from a pitch period waveform 14*a* (FIG. 2*a*) to form a shortened pitch period waveform 14*b* (FIG. 2*b*). Upon deletion of the four samples $D_1$ through $D_4$, an equal number of immediately preceding samples $P_1$ through $P_4$ are interpolated preferably as follows:

$$P_1' = 90\%\ P_1 + 10\%\ D_1$$

$$P_2' = 70\%\ P_2 + 30\%\ D_2$$

$$P_3' = 40\%\ P_3 + 60\%\ D_3$$

$$P_4' = 10\%\ P_4 + 90\%\ D_4$$

This produces a shortened waveform 14*b* which does not contain any distortion-producing discontinuities between samples $P_4'$ and $F_1$.

Extension of the waveform 14*a* (FIG. 2*a*) to produce the waveform 14*c* (FIG. 2*c*) is accomplished simply by repeating the last sample $P_4$ preceding the insertion the desired number of times.

Another practical way of varying pitch in a digital artificial speech system is to vary the dialout rate of the digitized waveform samples making up the voiced sounds of the speech. This approach moves the frequency spectrum evenly but does distort the speech (even if the overall speed of enunciation is held constant by repeating selected pitch periods) so as to give it a "Mickey Mouse"-like quality. This occurs because in real speech, the various harmonics making up the frequency spectrum of a voiced sound do not all change in the same proportion when the pitch of a speaker's voice varies. Changing the dialout rate, however, changes all harmonics in the same proportion, just as speeding up an analog recording does.

Experience has shown that in both of the foregoing pitch change methods, a small variation (on the order of 10% or less) in the dialout rate does not produce noticeable distortion, but that greater variations rapidly increase the distortion to an annoying level. For practical purposes, however, it is necessary to be able to vary the pitch by as much as 30–40% from the reference pitch for which the system is designed. It has now been found that this can be achieved by both varying the dialout rate and truncating or extending the pitch period waveform. Preferably, one third of any pitch change is accomplished by dialout rate variation, and two thirds by truncation or extension. When this is done, the two methods of variation complement each other and together result in a substantial pitch change capability without their individual deleterious effects.

Figure 3:
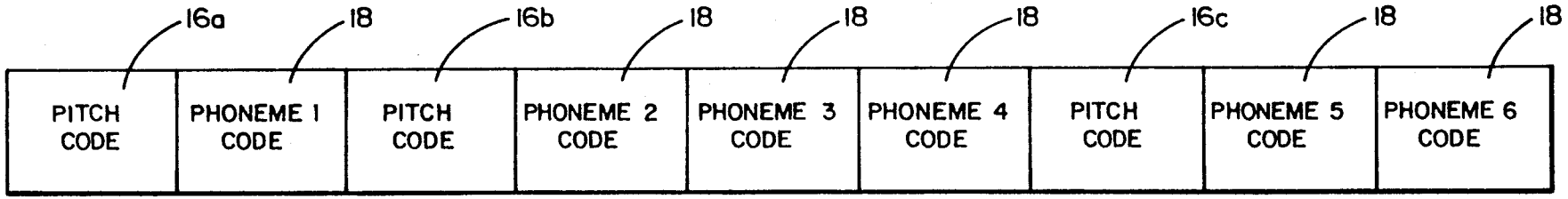
FIGS. 3 and 4 are time-amplitude diagrams with block form time references illustrating the predictive pitch changes of this invention.
Figure 4:
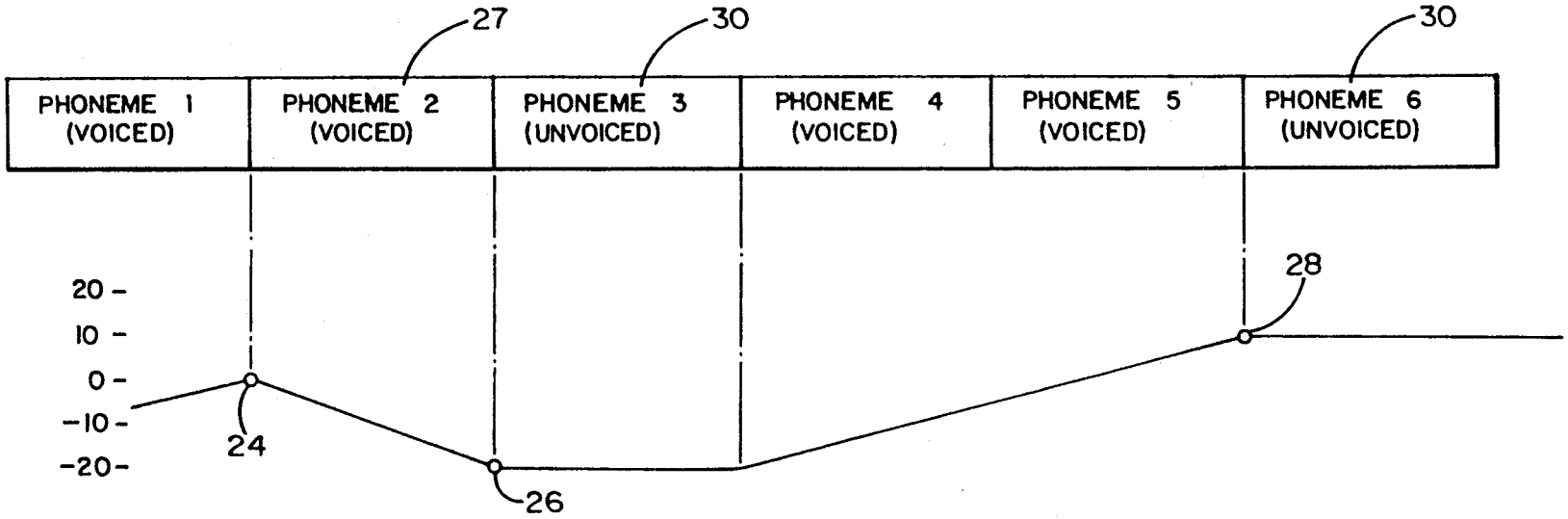

In another aspect of the invention, FIGS. 3 and 4 illustrate a novel method of smoothing pitch changes to make them sound more natural. Referring to FIG. 3, pitch changes are initiated by pitch codes 16*a–c* which precede voiced phoneme codes 18 in a text data train 20. Each pitch code such as 16*b* denotes a pitch level which remains in effect until the next pitch code 16*c*. Emphasis and speed codes (not shown) may be interspersed with the phoneme codes 18 in the same manner. In a conventional artificial speech system, the phoneme codes 18 may be used to select a sequence of stored address blocks (not shown) which in turn point to stored digitized waveforms (not shown). In voiced phonemes, each stored digitized waveform is typically one pitch period long. To produce speech, the digitized samples of these waveforms are conventionally sequentially dialed out and converted to analog signals.

In the system of this invention, the truncation or extension of pitch period waveforms, and the variation of the dialout rate, are pitch period parameters that are made variable in small increments. As illustrated in FIG. 4, each time an address block is read, and it is determined that the addressed waveform is a pitch period waveform of a voiced phoneme, these pitch period parameters are adjusted by an amount d/n, in which d is the total parameter change from one target pitch level 22 (identified by pitch code 16*a*) to the next target 24 (identified by pitch code 16*b*), and n is the total number of pitch periods lying between targets 22 and 24. The location of each target 22, 24, 26 may advantageously be selected as the end of the voiced phoneme immediately following the pitch codes 16*a*, 16*b* and 16*c*, respectively.

Each time the pitch level reaches a target such as 22, the speech generation system, before dialing out the pitch period waveform, looks for the next pitch code 16*b*; determines the number of pitch periods occurring before the target 24 following pitch code 16*b*; and recomputes the values d and n so that the pitch level will reach the target 26 set by pitch code 16*b* at the end of the voiced phoneme 27 whose phoneme code 18 follows the pitch code 16*b* in FIG. 3. When the target value 26 is reached, the process is repeated with pitch code 16*c* and target 28. Unvoiced phonemes such as 30 are ignored in the computation and modification.

Figure 5:
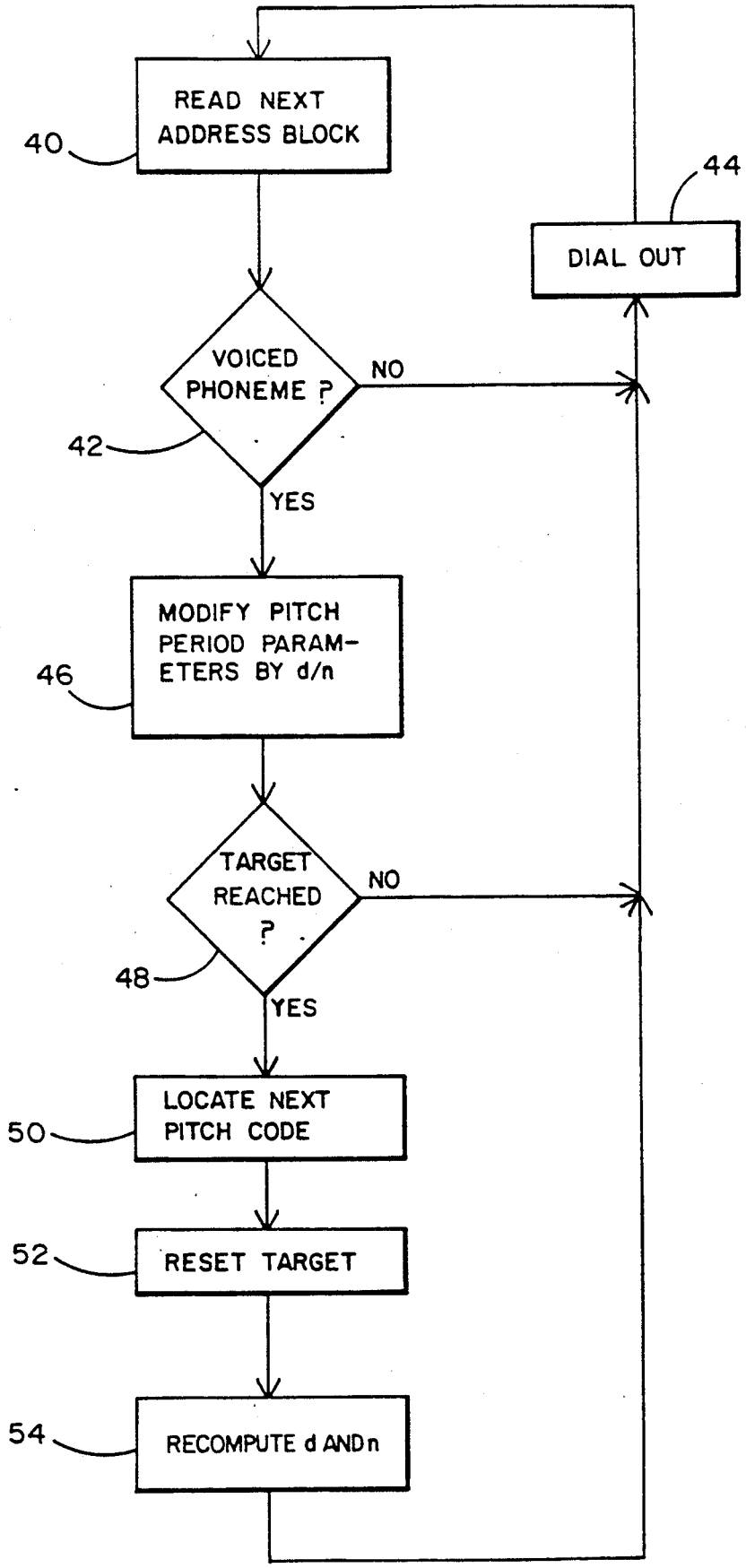
FIG. 5 is a flow chart illustrating the predictive pitch change method of FIG. 4.

The flow diagram of FIG. 5 shows the sequence of operations which carries out the method of FIG. 4. The reading of an address block identifying a pitch period of a phoneme begins at 40. The branching operation 42 dials the block out directly at 44 if the phoneme is unvoiced, but continues to operation 46 if it is voiced. Operation 46 modifies the pitch-related parameters of the waveform representing the identified pitch period by the amount d/n.

If the modification at 46 fails to cause the pitch-dependent parameters to reach their target value, the branching operation 48 dials out the modified pitch period waveform at 44. If, however, the target value of the parameters is reached, the program locates the next pitch code at 50, resets the target values at 52, and recomputes d and n for the next target at 54.

This system provides a soft transition from one pitch level to the next and gives the generated speech a more natural tone quality.

We claim:

1. A method of minimizing distortion due to prosody-related pitch changes in artificial speech, comprising the steps of:

a) digitally storing waveform samples defining pitch-period waveforms for voiced sounds of said artificial speech;

b) dialing out said samples at a selectable rate to generate said artificial speech;

c) deleting selected samples of said waveforms or adding samples to said waveforms to vary the length of said waveforms in order to vary the prosody-related pitch of said speech;

d) smoothing the transitions between said length-varied waveforms; and e) varying said dialout rate simultaneously with said deletion or addition of samples to further vary the prosody-related pitch of said speech.

2. The method of claim 1, in which said deleting or adding is done only in the most quiet portion of each of said waveforms.

3. A method of improving the naturalness of pitch changes in artificial speech, comprising the steps of:

a) generating a code train containing a sequence of phoneme codes and pitch codes defining, respectively, voiced and unvoiced speech phonemes to be produced and target pitch levels for said voiced phonemes, said voiced phonemes being composed of a large plurality of pitch periods, and each target level being associated with a specific pitch period of a voiced phoneme having a specific sequential relation to the pitch code identifying that target level;

b) producing, in accordance with said train of phoneme codes and pitch codes, a train of concatenated waveforms representing pitch period of phonemes defined by said phoneme codes at pitch levels defined by said pitch codes;

c) converting said waveform train into artificial speech;

d) determining, whenever the pitch level of a pitch period is equal to a target level, the next target level defined by the next pitch code and the number of pitch periods to said specific pitch period associated with said next target level; and e) changing the pitch value of each successive pitch period by an amount appropriate for reaching said next target level at said specific pitch period.

4. The method of claim 3, in which said specific pitch period is a predetermined pitch period of the first voiced phoneme defined by a phoneme code following the pitch code defining said next target level.

5. The method of claim 4, in which said specific pitch period is at the center of said first voiced phoneme.

6. The method of claim 3, in which said pitch value remains constant during unvoiced phonemes.

7. The method of claim 1, in which substantially one third of each pitch variation is produced by varying said dialout rate, and two thirds are produced by deleting or adding samples.

* * * * *